United States Patent [19]

Hirano

[11] Patent Number: 4,664,073

[45] Date of Patent: May 12, 1987

[54] COOLING SYSTEM FOR AUTOMOTIVE ENGINE OR THE LIKE

[75] Inventor: Yoshinori Hirano, Yokohama, Japan

[73] Assignee: Nissan Motor Co., Ltd., Yokohama, Japan

[21] Appl. No.: 822,882

[22] Filed: Jan. 27, 1986

[30] Foreign Application Priority Data

Jan. 28, 1985 [JP] Japan ..... 60-14080
Jul. 8, 1985 [JP] Japan ..... 60-149812

[51] Int. Cl.[4] ..... F01P 3/22
[52] U.S. Cl. ..... 123/41.21; 123/41.27
[58] Field of Search ..... 123/41.2–41.27

[56] References Cited

U.S. PATENT DOCUMENTS 2,086,441 7/1937 Rushmore ..... 123/41.27
2,292,946 8/1942 Karig ..... 123/174
2,413,770 1/1947 Knoy ..... 123/174
4,367,699 1/1983 Evans ..... 123/41.23
4,548,183 10/1985 Hayashi ..... 123/41.15
4,549,505 10/1985 Hirano ..... 123/41.08
4,584,971 4/1986 Neitz et al. ..... 123/41.27

FOREIGN PATENT DOCUMENTS 0167169 1/1986 European Pat. Off. .
706955 5/1941 Fed. Rep. of Germany .

*Primary Examiner*—William A. Cuchlinski, Jr.
*Attorney, Agent, or Firm*—Schwartz, Jeffery, Schwaab, Mack, Blumenthal & Evans

[57] ABSTRACT

In order to ensure that due to the nature of the evaporative cooling of the engine, the anti-freeze in the coolant does not concentrate in the coolant jacket leaving the coolant in the radiator diluted to the point of being susceptible to freezing in cold weather, a transfer conduit is connected with a cabin heating circuit at a location downstream of the heater circulation pump discharge port and arranged to transfer a portion of the pump discharge across to the radiator in a manner that the "distilled" condensate is blended with liquid coolant containing sufficient anti-freeze that the blending maintains an essentially uniform distribution of the anti-freeze throughout the system.

11 Claims, 14 Drawing Figures

COOLING SYSTEM FOR AUTOMOTIVE ENGINE OR THE LIKE

BACKGROUND OF THE INVENTION

1. Field of the Invention

The present invention relates generally to an evaporative type cooling system for an internal combustion engine wherein liquid coolant is permitted to boil and the vapor used as a vehicle for removing heat therefrom, and more specifically to such a system which is able to prevent localized concentration of anit-freeze in the coolant jacket due to the distillation-like process which characterizes the cooling of evaporation type systems.

2. Description of the Prior Art

In currently used "water cooled" internal combustion engines such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) is operated full throttle, the cooling system is required to remove approximately 4000 Kcal/h. In order to achieve this, a flow rate of 167 liter/min (viz., $4000-60\times\frac{1}{4}$) must be produced by the water pump. This of course undesirably consumes a number of otherwise useful horsepower.

Further, the large amount of coolant utilized in this type of system renders the possibility of quickly changing the temperature of the coolant in a manner that instant coolant temperature can be matched with the instant set of engine operational conditions such as load and engine speed, completely out of the question.

FIG. 2 shows an arrangement disclosed in Japanese Patent Application Second Provisional Publication No. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement while eliminating the power consuming coolant circulation pump which plagues the above mentioned arragement, has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to readily escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to come out of solution and form small bubbles in the radiator which adhere to the walls thereof and form an insulating layer. The undissolved air also tends to collect in the upper section of the radiator and inhibit the convection-like circulation of the vapor from the cylinder block to the radiator. This of course further deteriorates the performance of the device.

Moreover, with the above disclosed arrangement the possibility of varying the coolant temperature with load is prevented by the maintainance of the internal pressure of the system constantly at atmospheric level.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boilings. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that when the engine is stopped and cools down the coolant vapor condenses and induces sub-atmospheric conditions which tend to induce air to leak into the system. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms pockets of air which cause a kind of "embolism" in the radiator and which badly impair the heat exchange ability thereof. With this arrangement the provision of the compressor renders the control of the pressure prevailing in the cooling circuit for the purpose of varying the coolant boiling point with load and/or engine speed difficult.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature of the radiator is controlled by selective energizations of the fan 9 which maintains a rate of condensation therein sufficient to provide a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the bulky separation tank 6 also renders engine layout difficult.

Further, the rate of condensation in the consensor is controlled by a temperature sensor disposed on or in the condensor per se in a manner which holds the pressure and temperature within the system essentially constant. Accordingly, temperature variation with load is rendered impossible.

Japanese Patent Application First Provisional Publication No. 56-32026 (see FIG. 4 of the drawings) discloses an arrangement wherein the structure defining the cylinder head and cylinder liners are covered in a porous layer of ceramic material 12 and wherein coolant is sprayed into the cylinder block from shower-like arrangements 13 located above the cylinder heads 14. The interior of the coolant jacket defined within the engine proper is essentially filled with gaseous coolant during engine operation at which time liquid coolant sprayed onto the ceramic layers 12.

However, this arrangement has proven totally unsatisfactory in that upon boiling of the liquid coolant absorbed into the ceramic layers, the vapor thus produced and which escapes into the coolant jacket, inhibits the penetration of fresh liquid coolant and induces the situation wherein rapid overheat and thermal damage of the ceramic layers 12 and/or engine soon results. Further, this arrangement is of the closed circuit type and is plagued with air contamination and blockages in the radiator similar to the compressor equipped arrangement discussed above.

FIG. 7 shows an arrangement which is disclosed in U.S. Pat. No. 4,549,505 filed on Oct. 29, 1985 in the name of Hirano. The disclosure of this application is hereby incorporated by reference thereto.

For convenience the same numerals as used in the above mentioned Patent are also used in FIG. 7.

This arrangement while solving the problems encountered with the above described prior art has itself encountered the drawback that in the event that a solution water and ethylene glycol (for example) anti-freeze is used, as the latter mentioned substance is non-azeotropic, the vapor produced in the coolant jacket 120 contains a greatly reduced amount of anti-freeze as compared with the liquid coolant therein and accordingly, as time passes a notable concentration of anti-freeze tends to build-up in the coolant jacket 120 leaving the coolant which is contained in the remainder of the system (paticulary the radiator 126 and collection vessel 128 at the bottom thereof) diluted to the point of being apt to freeze in cold environments. Viz., as time goes by, a kind of "distillation" process occurs which dilutes the concentration of coolant in the radiator and associated conduiting which are the most susceptible elements of the engine to the cold. Even when the engine is stopped and the interior of the cooling circuit is filled with coolant from the reservoir 146 still the distribution tends to persist.

FIG. 8 shows an arrangement which although has bascially suffered from the various drawbacks set forth hereinbefore, has attempted to unify the concentration of anti-freeze in the engine coolant by providing a conduit 20 which interlinks the bottom of the radiator or condenser 22 and a section of the coolant jacket 24 whereat the concentration of anti-freeze is proportedly apt to be the highest. With this arrangement it is asserted that the concentration of coolant in the engine radiator or condensor 22 can be maintained essentially equal to the that in the coolant jacket 24.

However, as will be noted with the provision of this "blending" conduit 20 the tendancy for the level of coolant in the coolant jacket 24 and the condensor 22 is apt to become equal. In order to prevent this it would appear that the coolant return pump 26 must have a relatively large capacity and constantly energized so as to ensure that an adequate amount of coolant is constantly retained in the coolant jacket 24 despite the "drain" which is provided by the blending conduit 20.

The application of this concept to the cooling system shown in FIG. 7 of course is impractical as it tends to destroy the control of the liquid coolant level in the radiator 126 and thus the ability of the system to control the heat exchange capacity of the radiator for the purposes of coolant temperature control.

SUMMARY OF THE INVENTION

It is an object of the present invention to provide an arrangement for the type of cooling system employed in the arrangement of FIG. 7 which enables the concentration of anti-freeze in the engine coolant to be maintained relatively constant during operation in cold enironments wherein such it of importance.

In brief, the above objects are achieved by an arangement wherein, in order to ensure that due to the nature of the evporative cooling of the engine, the anti-freeze in the coolant does not concentrate in the coolant jacket leaving the coolant in the radiator diluted to the point of being suseptible to freezing in cold weather, a transfer conduit is connected with a cabin heating circuit at a location downstream of the heater circulation pump discharge port and arranged to transfer a portion of the pump discharge across to the radiator in a manner that the "distilled" condensate is blended with liquid coolant containing sufficient anti-freeze that the blending maintains an essentially uniform distribution of the anti-freeze throughout the system.

More specifically, a first aspect of the present invention comes in the form of an internal combustion engine having a structure subject to high heat flux, and a cooling system for removing heat from the engine which is characterized by: (a) a cooling circuit which includes: a coolant jacket formed about the structure, the coolant jacket being arranged to receive coolant in liquid form and discharge same in gaseous form; a radiator which fluidly communicates with the coolant jacket and in which gaseous coolant produced in the coolant jacket is condensed to its liquid form; and means for returning the condensate formed in the radiator to the coolant jacket in a manner which maintains the structure subject to high heat flux immersed in a predetermined depth of liquid coolant; (b) an auxiliary circit which fluidly communicates with the cooling circuit, the auxiliary circuit including: an induction conduit which fluidly communicates with the cooling jacket; a return conduit which fluidly communicates with the coolant jacket; and coolant circulation pump disposed in the return conduit, the coolant circulation pump being selectively energizable to pump coolant through the auxiliary circuit; and (c) a transfer conduit, the transfer conduit fluidly communicating at a first end thereof with the return conduit at a location downstream of the coolant return pump and a second end thereof with the cooling circuit at a location upstream of the radiator and downstream of the coolant jacket with respect to the direction in which the vapor produced in the coolant jacket flows to the radiator, the transfer conduit being arranged to deliver a portion of the discharge of the circulation pump when the pump is energized, into the radiator so as to mix with the condensate which forms therein.

A second aspect of the present invention comes in the form of a method of cooling an internal combustion engine having a structure subject to high heat flux comprising the steps of: introducing liquid coolant containing an anti-freeze into a coolant jacket disposed about the heated structure; permitting the liquid coolant to boil and produce coolant vapor; condensing the vapor produced in the coolant jacket in a radiator; circulating a portion of the heated liquid coolant through an auxiliary circuit using a circulation pump; transferring a portion of the circulation pump discharge to the radiator in a manner to blend with the condensate formed therein and maintain the concentration of anti-freeze in the coolant in the coolant jacket approximately equal to that in the coolant in the radiator.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the embodiments of the present invention, it is deemed appropriate to discuss some of the basic features of the type of cooling system to which the present invention is directed.

Figure 1:
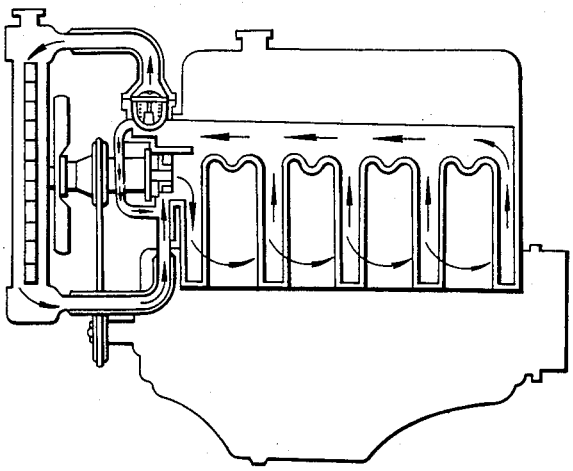
FIG.1 (PRIOR ART)
FIGS. 1 to 4 show the prior art arrangements discussed in the opening paragraphs of the instant disclosure.
Figure 2:
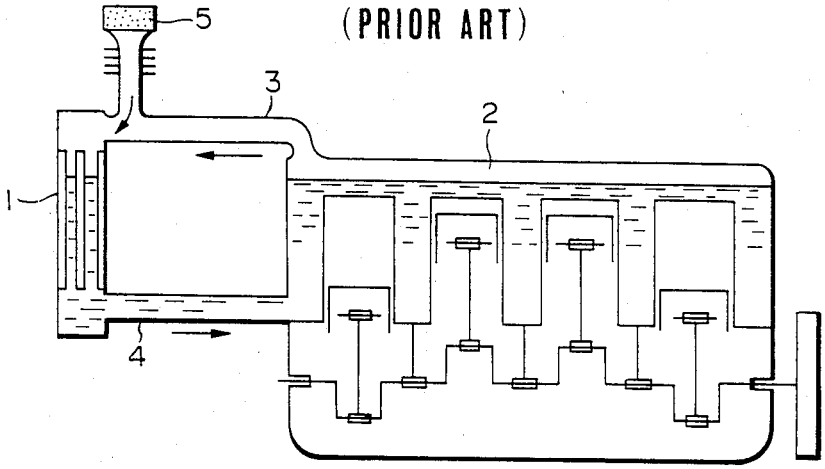
FIG.2 (PRIOR ART)
Figure 3:
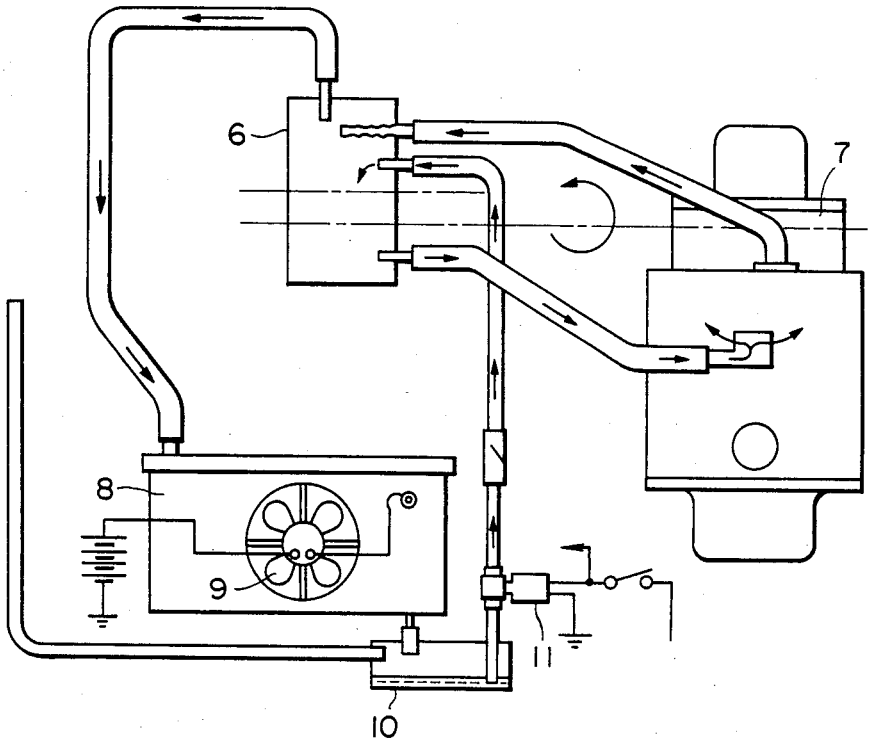
FIG.3 (PRIOR ART)
Figure 4:
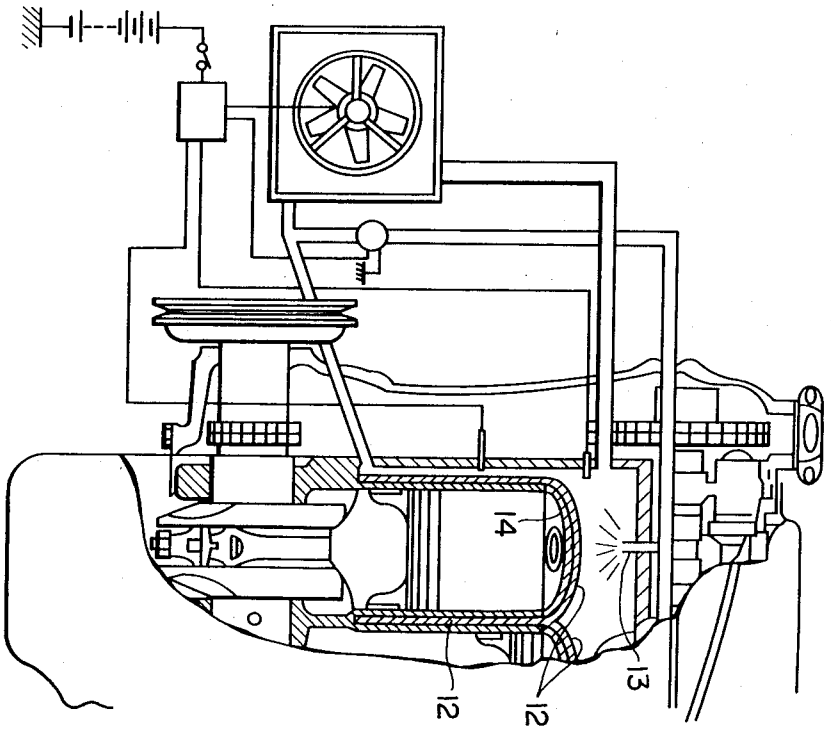
FIG.4 (PRIOR ART)
Figure 5:
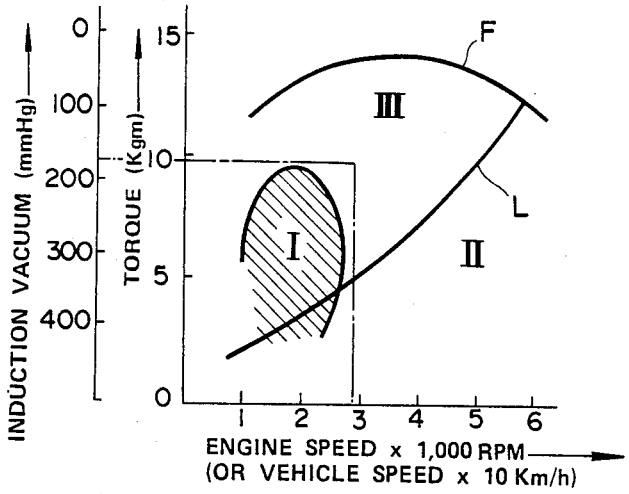
FIG. 5 is a diagram showing in terms of engine load and engine speed the various load zones which are encountered by an automotive internal combustion engine.
Figure 6:
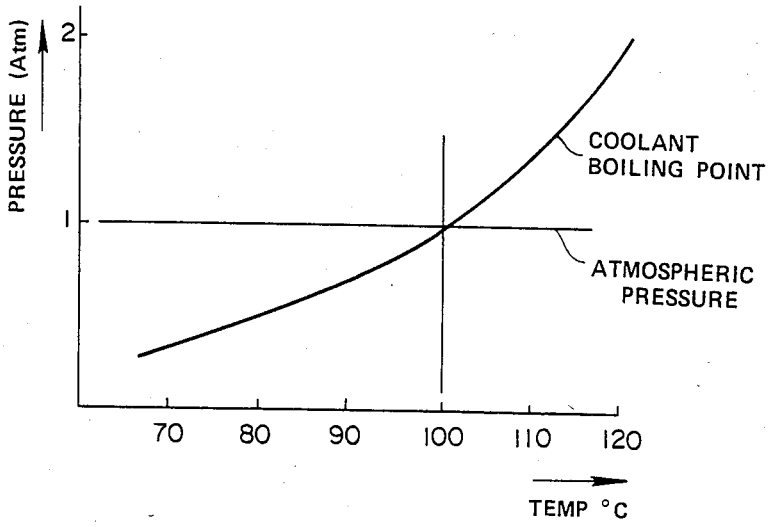
FIG. 6 is a graph showing in terms of pressure and temperature the changes in the coolant boiling point in a closed circuit type evaporative cooling system.
Figure 7:
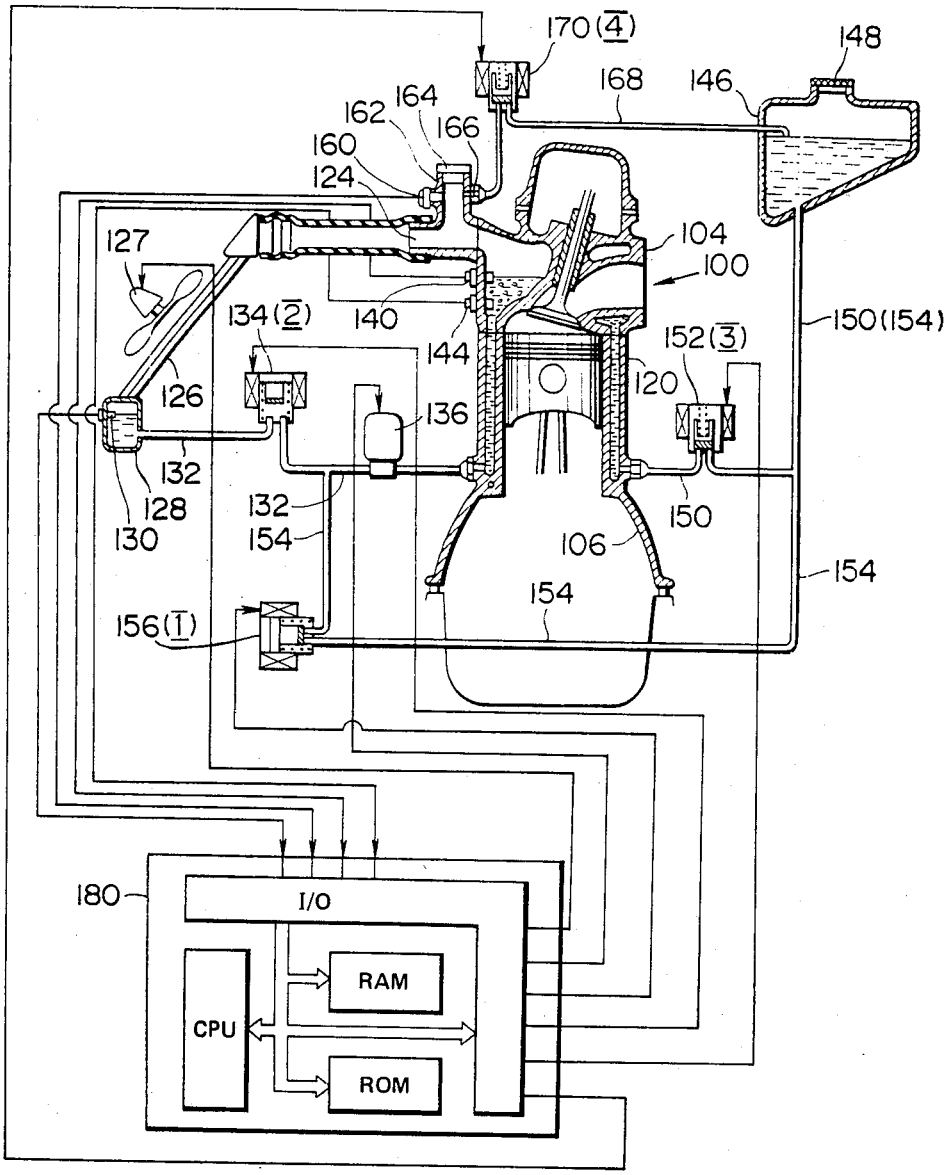
FIG.7 PRIOR ART
FIG. 7 shows in schematic elevation the arrangement disclosed in the opening paragraphs of the instant disclosure in conjunction with copending U.S. Ser. No. 661,911.
Figure 8:
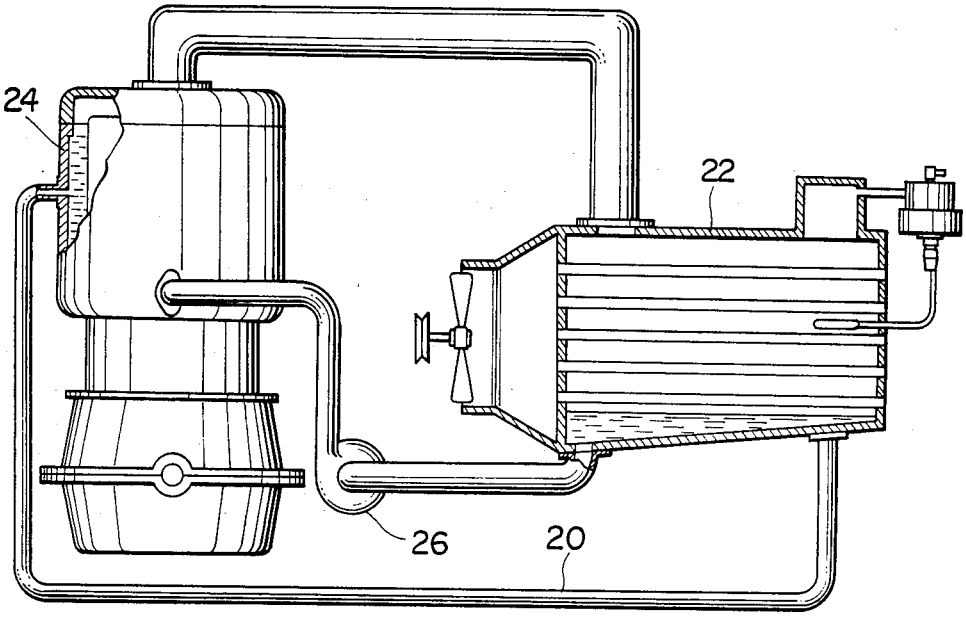
FIG. 8 PRIOR ART
FIG. 8 shows a prior art arrangement which has attempted to unify the distribution of anti-freeze throughout the system.

FIG. 5 graphically shows in terms of engine torque and engine speed the various load "zones" which are encountered by an automotive vehicle engine. In this graph, the curve F denotes full throttle torque characteristics, trace R/L denotes the resistance encountered when a vehicle is running on a level surface, and zones A, B and C denote respectively low load/low engine speed operation such as encountered during what shall be referred to "urban cruising"; low speed high/load engine operation such as hillclimbing, towing etc., and high engine speed operation such as encountered during high speed cruising.

A suitable coolant temperature for zone A is approximately 100°-110° C.; for zone B 80°-90° C. and for zone C 90°-100° C. The high temperature during "urban cruising" promotes improved charging efficiency. On the other hand, the lower temperatures of zones B and C are such as to ensure that sufficient heat is removed from the engine and associated structure to prevent engine knocking and/or thermal damage.

With the present invention, in order to control the temperature of the engine, advantage is taken of the fact that with a cooling system wherein the coolant is boiled and the vapor used as a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is of the closed circuit type. Thus, during "urban cruising" by circulating only a limited amount of cooling air over the radiator, it is possible reduce the rate of condensation therein and cause the pressure within the cooling system to rise above atmospheric and thus induce the situation, wherein the engine coolant boils at temperatures above 100° C. for example at approximately 110° C.

In addition to the control afforded by the air circulation the present invention is arranged to positively pump coolant into the system so as to vary the amount of coolant actually in the cooling circuit in a manner which modifies the pressure prevailing therein. The combination of the two controls enables the temperature at which the coolant boils to be quickly brought to and held close to that deemed most appropriate for the instant set of operation conditions.

On the other hand, during high speed cruising for example, when a lower coolant boiling point is highly beneficial, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 100° C. In addition to this, the present invention also provides for coolant to be displaced out of the cooling circiut in a manner which lowers the pressure in the system and supplements the control provide by the fan in a manner which permits the temperature at which the coolant boils to be quickly brought to and held at a level most appropriate for the new set of operating conditions.

However, if the pressure in the system drops to an excessively low level the tendancy for air to find its way into the interior of the cooling circuit becomes excessively high and it is desirable under these circumstances to limit the degree to which a negative pressure is permitted to develop. The present invention controls this by introducing coolant into the cooling circuit while it remains in an essentially hermetically sealed state and raises the pressure in the system to a suitable level.

Each of the zones of control be discussed in detail. It should be noted that the figures quoted in this discussion relate to a reciprocating type internal engine having a 1800 cc displacement.

ZONE A

In this zone (low speed/low torque) as the torque requirents are not high, emphasis is placed on good fuel economy. Accordingly, the lower limit of the temperature range of 100° to 110° C. is selected on the basis that, above 100° C. the fuel consumption curves of the engine tend to flatten out and become essentially constant. On the other hand, the upper limit of this range is selected in view of the fact that if the temperature of the coolant rises to above 110° C., as the vehicle is inevitably not moving at any particular speed during this mode of operation there is very little natural air circulation within the engine compartment and the temperature of the engine room tends to become sufficiently high as to have an adverse effect on various temperature sensitive elements such as cog belts of the valve timing gear train, elastomeric fuel hoses and the like. Accordingly, as no particular improvement in fuel consumption characteristics are obtained by controlling the coolant temperature to levels in excess of 110° C., the upper limit of zone A is held thereat.

It has been found that the torque generation characteristics tend to drop off slightly with temperatures above 100° C., accordingly, in order to minimize the loss of torque it is deemed advantageous to set the upper torque limit of zone A in the range of 7 to 10 kgm.

The upper engine speed of this zone is determined in view of that fact that above engine speeds of 2400 to 3600 RPM a slight increase in fuel consumption characteristics can be detected. Hence, as it is fuel economy rather than maximum torque production characteristics which are sought in this zone, the boundry between the low and high engine speed ranges is drawn within the just mentioned engine speed range. It will be of course appreicated as there are a variety of different types of engines on the market—viz., diesel engines (eg. trucks industrial vehicles), high performance engines (eg. sports cars), low stressed engines for economical urban use vehicles, etc., the above mentioned ranges cannot be specified with any particular type in mind but do hold generally true for all types.

ZONE B

In this zone (high torque/low engine speed) torque is of importance. In order to avoid engine knocking, improve engine charging efficiency, reduce residual gas in the engine combustion chambers and maximize torque generation, the temperature range for this zone is selected to span from 80° to 90° C. With this a notable improvement in torque characteristics is possible. Further, by selecting the upper engine speed for this zone to fall in the range of 2,400 to 3600 RPM it is possible to improve torque generation as compared with the case wherein the coolant temperature is held at 100° C., while simultaneously improving the fuel consumption characteristics.

The lower temperature of this zone is selected in view of the fact that if anti-freeze is mixed with the coolant, at a temperature of 80° C. the pressure prevailing in the interior of the cooling system lowers to approximately 630 mmHg. At this pressure the tendancy for atmospheric air to leak in past the gaskets and seals of the engine becomes particularly high. Hence, in order to avoid the need for expensive parts in order to maintain the relatively high negative pressure (viz., prevent crushing of the radiator and interconnecting conduiting) and simultaneously prevent the invasion of air the above mentioned lower limit is selected.

ZONE C

In this zone (high speed) as the respiration characteritics of the engine inherently improve, it is not necessary to maintain the coolant temperature as low as in zone B for this purpose. However, as the amount of heat generated per unit time is higher than during the lower speed modes the coolant tends to boil much more vigorously. As a result an increased amount of liquid coolant tends to bump and froth up out of the coolant jacket and find its way into the radiator.

Until the volume of liquid coolant which enters the radiator reaches approximately 3 liters/min. there is little or no adverse effect on the amount of heat which can released from the radiator. However, in excess of this figure, a marked loss of heat exchange efficiency may be observed. Experiments have shown that by controlling the boiling point of the coolant in the region of 90° C. under high speed cruising the amount of liquid coolant can kept below the critical level and thus the system undergoes no particular adverse loss of heat release characteristics at a time when the maximization of same is vital to prevent engine overheat.

It has been further observed that if the coolant temperature is permitted to rise above 100° C. then the temperature of the engine lubricant tends to rise above 130° C. and undergo uncessarily rapid degredation. This tendency is particular notable if the ambient temperature is above 35° C. As will be appreciated if the engine oil begins to degrade under high temperature, heat sensitive bearing metals and the like of the engine also undergo damage.

Hence, from the point of engine protection the coolant is controlled within the range of 90°-100° C. once the engine speed has exceeded the value which divides the high and low engine speed ranges.

FIRST EMBODIMENT

Figure 9:
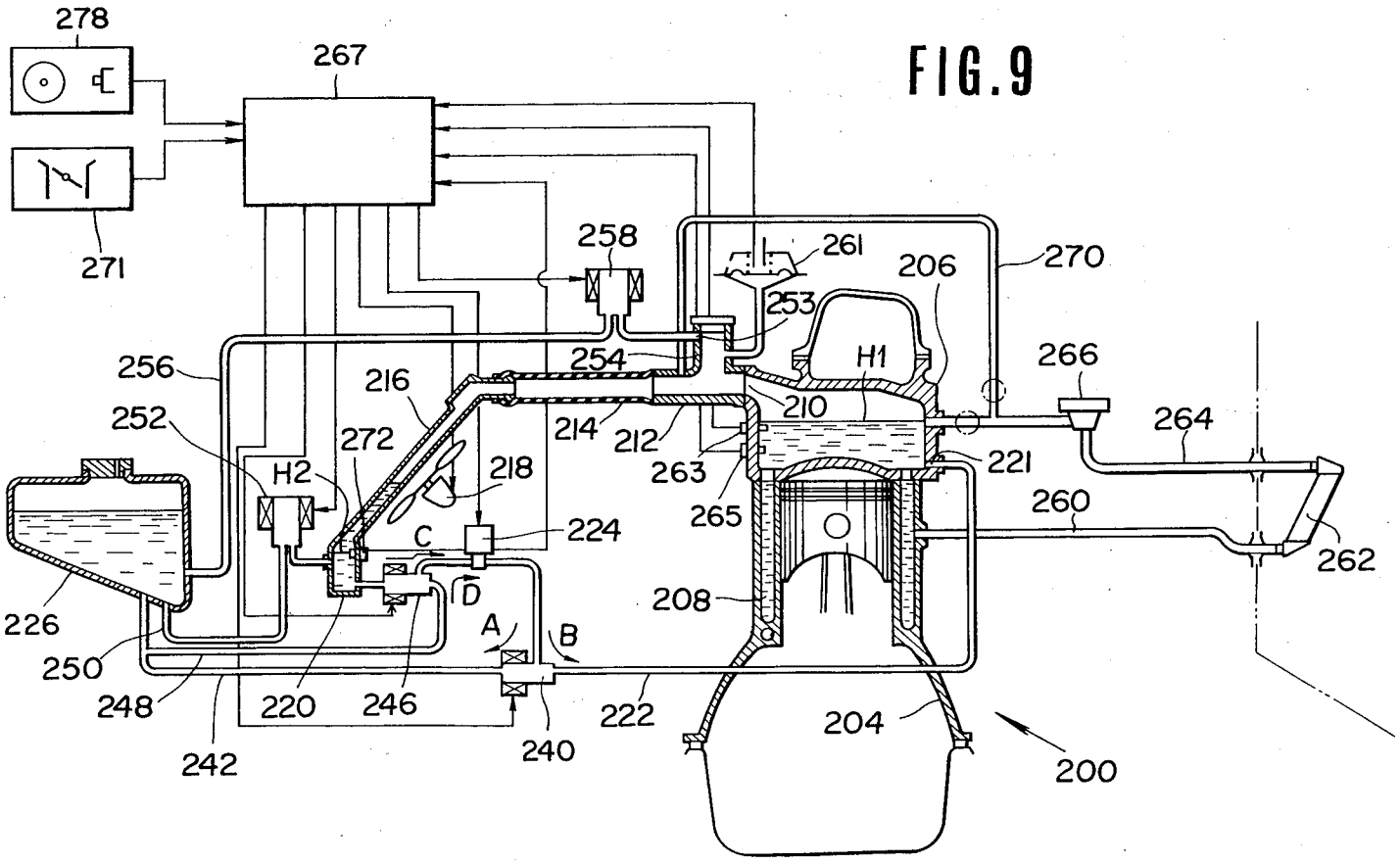
FIG. 9 shows a engine cooling system incorporating a first embodiment of the the present invention.

FIG. 9 of the drawings shows a first embodiment of the present invention. In this arrangement an internal combution engine 200 includes a cylinder block 204 on which a cylinder head 206 is detachably secured. The cylinder head and block are formed with suitably cavities which define a coolant jacket 208 about structure of the engine subject to high heat flux (e.g. combustion chambers exhaust valves conduits etc.,). Fluidly communicating with a vapor discharge port 210 formed in the cylinder head 206 via a vapor manifold 212 and vapor conduit 214, is a condensor 216 or radiator as it will be referred to hereinafter. Located adjacent the raditor 216 is a selectively energizable electrically driven fan 218 which is arranged to induce a cooling draft of air to pass over the heat exchanging surface of the radiator 216 upon being put into operation.

A small collection reservoir 220 or lower tank as it will be referred to hereinlater is provided at the bottom of the radiator 216 and arranged to collect the condensate produced therein. Leading from the lower tank 220 to a coolant inlet port 221 formed in the cylinder head 206 is a coolant return conduit 222. A small capacity electrically driven pump 224 is disposed in this conduit at a location relatively close to the radiator 216.

A coolant reservoir 226 is arranged to communicate with the cooling circuit—viz., a closed loop circuit comprised of the coolant jacket 208, vapor manifold 212, vapor transfer conduit 214, radiator, lower tank 220 and the coolant return conduit 222—via a valve and conduit arrangement. It should be noted that the interior of the reservoir is maintained constantly at atmospheric level by the provision of a small air bleed in the cap which closes the filler port thereof.

In this embodiment the valve and conduit means includes: four electromagnetic valves and four conduits. Viz., as shown this arrangement includes:

A first three-way 240 valve disposed in the coolant return conduit 222 at a location between the pump 224 and the coolant jacket 208. This valve 240 fluidly communicates with the reservoir 226 via a coolant return conduit 242. This valve 240 has a first position wherein communication between the pump 224 and the reservoir 226 is established (flow path A) and a second position wherein communication between the pump 224 and the coolant jacket 208 (flow path B) is provided.

A second three-way valve 246 is disposed in the coolant return conduit 222 at a location between the pump 224 and the lower tank 220. This valve 246 communicates with the reservoir 226 via a coolant supply conduit 248 and is arranged to selectively provide one of (a) communication between the lower tank 220 and the pump 224 or (b) between the reservoir 226 and the pump 224 (i.e. selectively establish flow paths C or D).

The reservoir 226 further communicates with the lower tank 220 via a supply/discharge conduit 250 in which an ON/OFF valve 252 is disposed. This valve 252 is arranged to assume a closed position when energized. The reason for this arrangement will become clear when a discussion relating to the engine shutdown control is made.

Leading from a so called "purge" port 253 formed in a riser 254 formed in the vapor manifold 212 is an overflow conduit 256. The riser is provided with a cap which hermetically closes the same.

The overflow conduit 256 includes a normally closed valve 258 which is opened only upon energization. However, as a saftey precaution valve 258 can be arranged to that upon a predetermined maximum permissible pressure prevailing in the cooling system, the valve element thereof is moved to an open position in a manner which permits the excess pressure to be automatically vented. It will be noted that the overflow conduit 256 is arranged to communicate with a lower section of the reservoir 226 so that in the event that the just mentioned venting of high pressure coolant vapor occurs, a kind of "steam trap" is defined which induces condensation of the vented vapor and prevents any appreciable loss of the same.

In this embodiment a vehicle cabin heater includes a circulation circuit comprised of a first conduit 260 which leads from the section of the coolant jacket 208 formed in the cylinder block 204 to a heat exchanger core 262 through which cabin and/or fresh air is circulated. Leading from the core 262 to the section of the coolant jacket formed in the cylinder head 206 is a return conduit 264 in which a circulation pump 266 is disposed. With this arrangement when the pump 266 is energized upon a demand for cabin heating such as inevitably occurs in cold weather, coolant is inducted from the lower section of the coolant jacket 208, passed through the core 262 and returned to a section of the coolant jacket in which the most vigorous boiling tends to occur. As the coolant which is returned from the cabin heater core 262 is relatively cool after being used to heat the cabin, the introduction thereof into this section tends to quell the bumping and frothing of the coolant to some degree and thus limit the amount of liquid coolant which tends to be boil over from the coolant jacket 208 and find its way into the radiator 216 in its liquid state particularly during high speed engine operation.

A conduit 270 which will be referred to hereinlater as a "transfer" conduit is arranged to intercommunicate a section of the return conduit 264 downstream of the return pump 266 with a section of the vapor manifold 212. This arrangement is such as to cause a portion of the coolant which is being returned to the coolant jacket 208 to be transferred across to a section of the cooling circuit which is "downstream" of the coolant jacket 208 and "upstream" of the radiator 216 and thus flow into the radiator 216 and blend with the partially "distilled" condensate which has collected in the lower portion of the radiator 216 and lower tank 220 in a manner which tends to unify the anti-freeze concentration therein.

In order to control the quantity of coolant which is transferred in this manner it is possible to arrange a flow restriction or restrictions (at locations indicated in phantom—by way of example) in the return and transfer conduits so as to carefully control the fraction of the discharge from pump 266 which actually flows through the transfer conduit 270. The reason for this measure will become clear hereinlater when a discussion of the graphs shown in FIGS. 11 to 14 is made.

Communicating with the riser 254 is a pressure differential responsive diaphragm operated switch arrangement 261 which assumes an open state upon the pressure prevailing within the cooling circuit (viz., the coolant jacket 208, vapor manifold 214, vapor conduit 214, radiator 216 and return conduit) dropping below atmospheric pressure by a predetermined amount. In this embodiment the switch 261 is arranged to open upon the pressure in the cooling circuit falling to a level in the order of −30 to −50 mmHg.

In order to control the level of coolant in the coolant jacket, a level sensor 263 is disposed as shown. It will be noted that this sensor 263 is located at a level (H1) which is higher than that of the combustion chambers, exhaust ports and valves (structure subject to high heat flux) so as to maintain same securely immersed in liquid coolant and therefore attenuate engine knocking and the like due to the formation of localized zones of abnormally high temperature or "hot spots".

Located below the level sensor 263 so as to be immersed in the liquid coolant is a temperature sensor 265. The output of the level sensor 263 and the temperature sensor 265 are fed to a control circuit 267 or modulator which is suitably connected with a source of EMF (not shown).

The control circuit 267 further receives an input from the engine distributor 278 (or like device) which outputs a signal indicative of engine speed and an input from a load sensing device 271 such as a throttle valve position sensor. It will be noted that as an alternative to throttle position, the output of an air flow meter or an induction vacuum sensor may be used to indicate load or the pulse width of fuel injection control signal. In the event that the engine to which the invention is applied is fuel injected, the fuel injection control signal can be used to supply both load and engine speed signals. Viz., the width of the injection pulses can be used to indicate load (as previously mentioned) while the frequency of the same used to indicate engine speed.

A second level sensor 272 is disposed in the lower tank 220 at a level H2. It should be noted that when the level of coolant in the coolant jacket is at level H1 and the level of coolant in the lower tank 220 is at level H2 the minimum amount of liquid coolant with which the cooling system can be assuredly operated with is contained therein.

OPERATION OVERVIEW

Prior to use the cooling circuit is filled to the brim with coolant (for example water or a mixture of water and antifreeze or the like) and the riser cap securely set in place to hermetically seal the system. A suitable quantity of additional coolant is also introduced into reservoir 226. At this time the electromagnetic valve 252 should be temporarily energized so as to assume a closed condition.

Alternatively, and/or in combination with the above, it is possible to introduce coolant into the reservoir 226 and manually energize valves 240 and 246 so as to produce flow paths B and D, respectively A while simimiltaneously energizing pump 224. This inducts coolant from the reservoir 226 via conduit 248 and pumps same into the coolant jacket 208 via port 221 until coolant can be visibly seen spilling out of the open riser. By securing the riser cap in position at this time the system may be sealed in a completely filled state.

To facilitate this filling and subsequent servicing of the system a manually operable switch may be arranged to permit the above operation from "under the hood" and without the need to actually start the engine.

When the engine is started, as the coolant jacket 208 is completely filled with stagnant coolant, the heat produced by the combustion in the combustion chambers cannot be readily released via the radiator 216 to the ambient atmosphere and the coolant in the coolant jacket rapidly warms and begins to produce coolant vapor. At this time valve 252 is left de-energized (open) whereby the pressure of the coolant vapor begins displacing liquid coolant out of the cooling circuit.

During this "coolant displacement mode" it is possible for either of two situations to occur. That is to say, it is possible for the level of coolant in the coolant jacket 208 to be reduced to level H1 before the level in the radiator 216 reaches level H2 or vice versa, viz., wherein the radiator 216 is emptied to level H2 before much of the coolant in the coolant jacket 208 is displaced. In the event that latter occurs (viz., the coolant level in the radiator falls to H2 before that in the coolant jacket reaches H1), valve 252 is temporarily closed and an amount of the excess coolant in the coolant jacket 208 allowed to "distill" over to the radiator 216 before valve 252 is reopened. Alternatively, if the level H1 is reached first, level sensor 263 induces the energization of pump 224 and coolant is pumped from the lower tank 220 to the coolant jacket 208 while simultaneously being displaced out through conduit 250 to reservoir 226.

The load and other operational parameters of the engine (viz., the outputs of the sensors 278 and 271) are sampled and a decision made as to the temperature at which the coolant should be controlled to boil. If the desired temperature is reached before the amount of the coolant in the cooling circuit is reduced to its minimum permissible level (viz., the coolant in the coolant jacket 208 and the radiator 216 are at levels H1 and H2, respectively) it is possible to energize valve 252 so that if assumes a closed state and places the cooling circuit in a hermetically closed condition. If the temperature at which the coolant boils should exceed that determined to be best suited for the instant set of engine operational conditions, three-way valve 240 may be set to establish flow path A and the pump 224 energized briefly to pump a quantity of coolant out of the cooling circuit to increase the surface "dry" (internal) surface area of the radiator 216 available for the coolant vapor to release its latent heat of evaporation and to simultaneously lower the pressure prevailing within the cooling circuit. It should be noted however, that upon the coolant in the circuit being reduced to the minimum level (viz., when the levels in the coolant jacket 208 and the lower tank 220 assumes levels H1 and H2 respectively) the displacement of coolant from the circuit is terminated in order to prevent a possible shortage of coolant in the coolant jacket 208.

On the other hand, should the ambient conditions be such that the rate of condensation in the radiator 216 is higher than that desired (viz., be subject to overcooling) and the pressure within the system overly lowered to assume a sub-atmospheric level, valve 252 is opened and coolant from the reservoir 226 is inducted into radiator 216 via the lower tank 220 under the influence of the pressure differential until the liquid level in the radiator rises to a suitable level. With this measure, the pressure prevailing in the cooling circuit is raised and the surface area available for heat exchange reduced. Accordingly, the boiling point of the coolant is modified by the change in internal pressure while the amount of heat which may be released from the system reduced. Accordingly, it is possible to rapidly elevate the boiling point to that determined to be necessary.

When the engine 200 is stopped (shut-down) it is advantageous to maintain valve 252 energized (viz., closed) until the pressure differential responsive switch arrangement 261 outputs a signal indicative of a slightly sub-atmospheric pressure. This obviates the problem wherein large amounts of coolant tends to be violently discharged from the cooling circuit due to the presence of superatmospheric pressures therein.

SECOND EMBODIMENT

Figure 10:
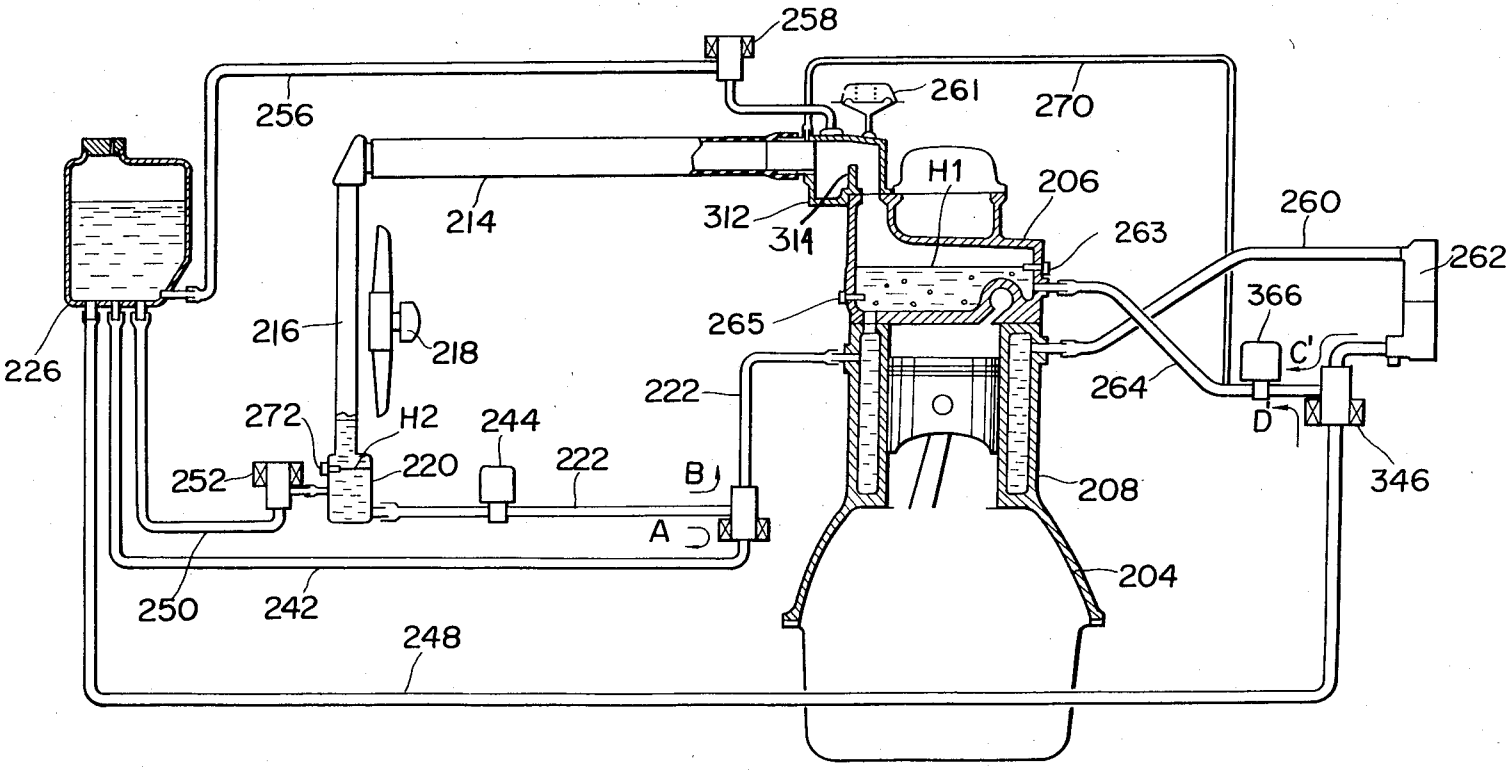
FIG. 10 shows a second engine cooling system incorporating a second embodiment of the present invention.

FIG. 10 shows a second embodiment of the present invention. In this embodiment the valve and conduit arrangement differs from that of the first embodiment in that the three-way valve 346 which corresponds to valve 246 of the first embodiment is disposed in the heater circulation circuit at a location downstream of the heater circulation pump 366.

With this arrangement when it is required to perform the purge operation wherein the coolant jacket 208 is overfilled with coolant from the reservoir 226, valve 346 is set to establish flow path D while the heater circulation pump 366 is energized. This induct coolant from the reservoir 226 and forces the same into the section of the coolant jacket 208 formed in the cylinder head 204.

In this embodiment the transfer conduit 270 is arranged to lead from the coolant return conduit 264 at a location downstream of the coolant circulation pump 366 and terminate in the vapor manifold. It will be noted that the vapor manifold 312 in this embodiment is configured so as to have a baffle-like member 314 which prevents excess coolant from bumping over into to the a coolant circulation pump disposed in said return conduit, said coolant circulation pump being selectively energizable to pump coolant through said auxiliary circuit; and (c) a transfer conduit, said transfer conduit fluidly communicating at a first end thereof with said return conduit at a location downstream of said coolant return pump and a second end thereof with said cooling circuit at a location upstream of said radiator and downstream of said coolant jacket with respect to the direction in which the vapor produced in said coolant jacket flows to said radiator, said transfer conduit being arranged to deliver a portion of the discharge of said circulation pump when said pump is energized, into said radiator so as to mix with the condensate which forms therein.

2. A cooling system as claimed in claim 1, wherein said returning means takes the form of:

a coolant return conduit which leads from said radiator to said coolant jacket;

a coolant return pump disposed in said coolant return conduit;

a level sensor disposed in said coolant jacket for sensing the level of liquid coolant at a predetermined level above said structure, said predetermined level being selected to immerse said structure in a predetermined depth of liquid coolant, said pump being responsive to said level sensor indicaing the level of coolant being below said predetermined level in a manner to pump condensate from said radiator to said coolant jacket until the liquid level reaches said predetermined level.

3. A cooling system as claimed in claim 2 further comprising:

a reservoir which is discrete from said cooling circuit; and valve and conduit means for selectively providing fluid communication between said reservoir and said cooling circuit.

4. A cooling system as claimed in claim 3, further comprising:

a device disposed with said radiator, said device being operable to increase the rate of heat exchange between said radiator and a cooling medium which surrounds said radiator; and a temperature sensor disposed in said coolant jacket so as to be immersed in the liquid coolant contained therein;

said device being responsive to the output of said temperature sensor in a manner to vary the rate of condensation in said radiator by varying the amount of heat exchange between said radiator and said cooling medium.

5. A cooling system as claimed in claim 4, further comprising:

a pressure differential responsive device, said pessure differential device being responsive to the pressure prevailing in said cooling circuit and the ambient atmospheric pressure in a manner to output a signal indicative of a predetermined pressure differential existing therebetween.

6. A cooling system as claimed in claim 5, wherein said valve and conduit means comprises:

a first three-way valve disposed in said coolant return conduit at a location between said coolant return pump and said coolant jacket;

a first conduit leading from said reservoir to said first three-way valve;

said first three-way valve having a first position wherein fluid communication between said pump and said coolant jacket is interrupted and communication between said reservoir and said coolant jacket established, and a second position wherein communication between said reservoir and said coolant jacket is interrupted and communication between said pump and said coolant jacket established;

a second three-way valve disposed in one of said coolant return conduit and the return conduit of said auxiliary circuit at a location upstream of an induction port of the pump which is disposed therein;

a second conduit which leads from said reservoir to said second three-way valve;

said second three-way valve having a first position wherein communication between said reservoir and the conduit in which said second three-way valve is disposed is prevented and a second position wherein exclusive communication between said reservoir said induction port is established;

a small collection vessel disposed at the bottom of said radiator for collecting the condensate which is formed therein;

a third conduit leading from said reservoir to said vessel;

a third valve disposed in said third conduit, said third valve having a first position wherein communication between said reservoir and said vessel is interrupted and a second position wherein communication is permitted;

a fourth conduit leading from the top of said cooling circuit to said reservoir; and a fourth valve disposed in said fourth conduit, said fourth valve having a first position wherein communication between said cooling circuit and said reservoir is prevented and a second position wherein the communication is permitted.

7. A cooling system as claimed in claim 6, further comprising a second level sensor, said second level sensor being disposed in said vessel and arranged to sense the level of coolant at a second predetermined level, said second predetermined level being selected so that when the level of coolant in said coolant jacket is at said first predetermined level and the level of coolant in said vessel is at said second predetermined level, the minimum amount of coolant which should be retained in the cooling circuit is contained therein.

8. A cooling system as claimed in claim 7 further comprising a control circuit, said control circuit being responsive to said first and second level sensors, said temperature sensor, and said pressure differential responsive device for controlling the operation of said coolant return pump, said circulation pump and said valve and conduit means.

9. A cooling system as claimed in claim 8 further comprising:

a sensor which senses an engine operational parameter which varies with load on the engine, and wherein said control circuit is responsive to said engine operational parameter sensor for determining the most suitable temperature at which the coolant in the coolant jacket should be induced to boil, and operative to control said device, said coolant return pump, circulation pump and valve and conduit means in a manner to induce condicoolant transfer conduit 214. It will also be noted that the transfer conduit 270 communicates with the manifold downstream of the trap like arrangement defined by the baffle member 314 and thus enables the coolant which passes through the transfer conduit 270 to flow along with the coolant vapor into the radiator 216 in a manner which enables the coolant "blending" which characterizes the present invention.

As the operation of this embodiment is essentially the same as that of the first one, no further disclosure is deemed necessary.

Figure 11:
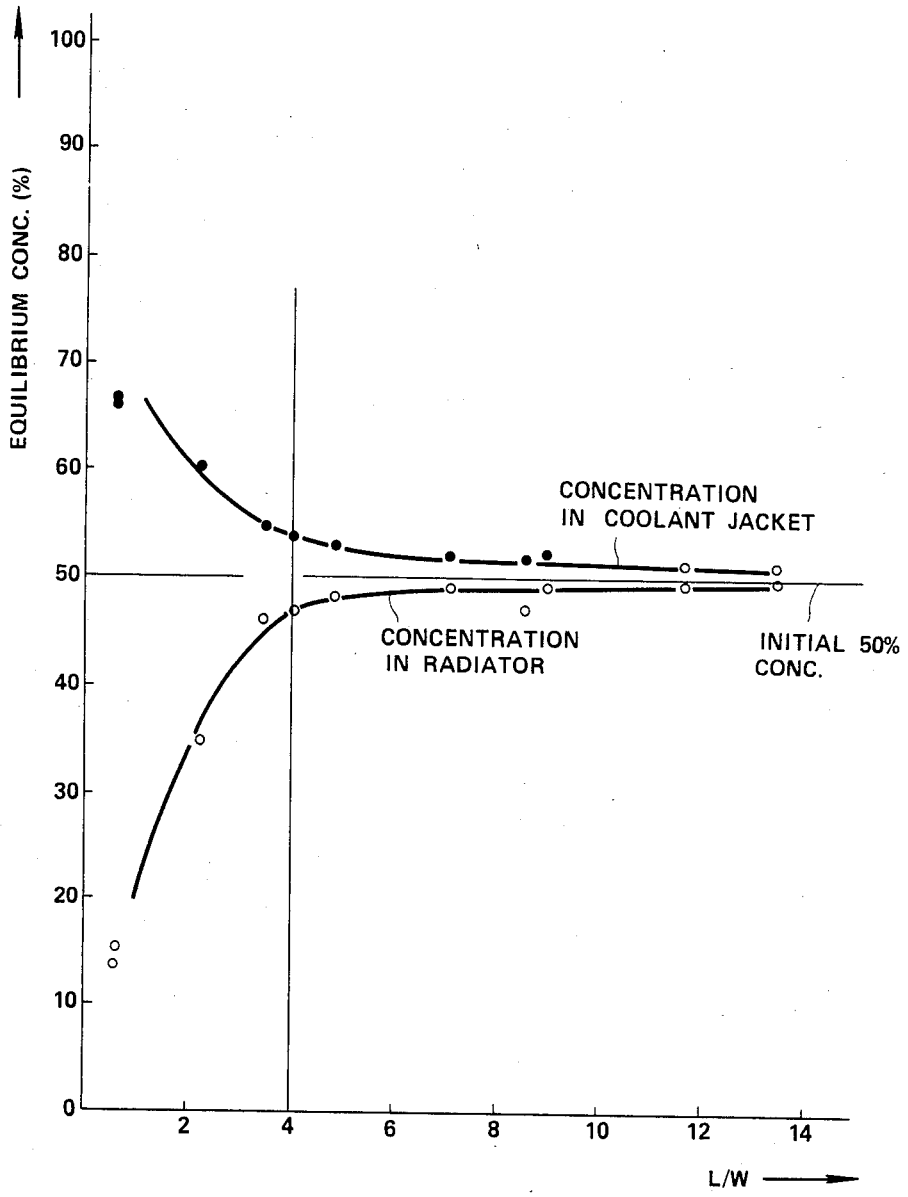
FIGS. 11 to 14 are graphs showing the various factors which influence the rate at which the anti-freeze tends to concentrate and the rates at which it is necessary to mix the coolant in the system in order to maintain a suitable uniformity in concentration.

FIG. 11 shows in graphical form the results of experiments which were conducted to determine the tendancy with which the ethylene glycol concentration of a so called LLC (long life coolant—a mixture of water, ethylene glycol and a trace of suitable anticorrosive)—tends to vary between the coolant jacket and the radiator with the ratio of L/W where: L denotes the volume of liquid coolant which flows from the coolant jacket to the radiator and W the amount of coolant in vapor form.

As shown, while the ratio of L/W has a value of 4 or more, the distribution of anti-freeze between the coolant jacket and the radiator remains within acceptable ranges, however, as the L/W ratio falls below a value of 4 the concentration of anti-freeze in the coolant jacket increases markedly with a corresponding rapid depletion of the same in the radiator.

Accordingly, it is deemed necessary in order to overcome the anti-freeze concentration problem to ensure that sufficient coolant is transferred through transfer conduit to maintain the L/W ratio at or about 4.

However, as a substantial quantity of liquid coolant tends to bump and froth its way out of the coolant jacket (viz., boil over) into the radiator during high speed operation, for example, it is necessary to ensure that while the engine is operating under low low load conditions the L/W rate is at least 4 while when under high load the value of L/W is not less than 4.

Experiments have shown that with an engine of 2000 cc displacement the amount of liquid coolant that need be delivered through the transfer conduit in order to achieve the above is in the order of 1 liter/min. In excess of this rate, the amount of liquid coolant which is introduced into the radiator becomes excessive and deteriorates the heat exchange efficiency of the same.

Figure 12:
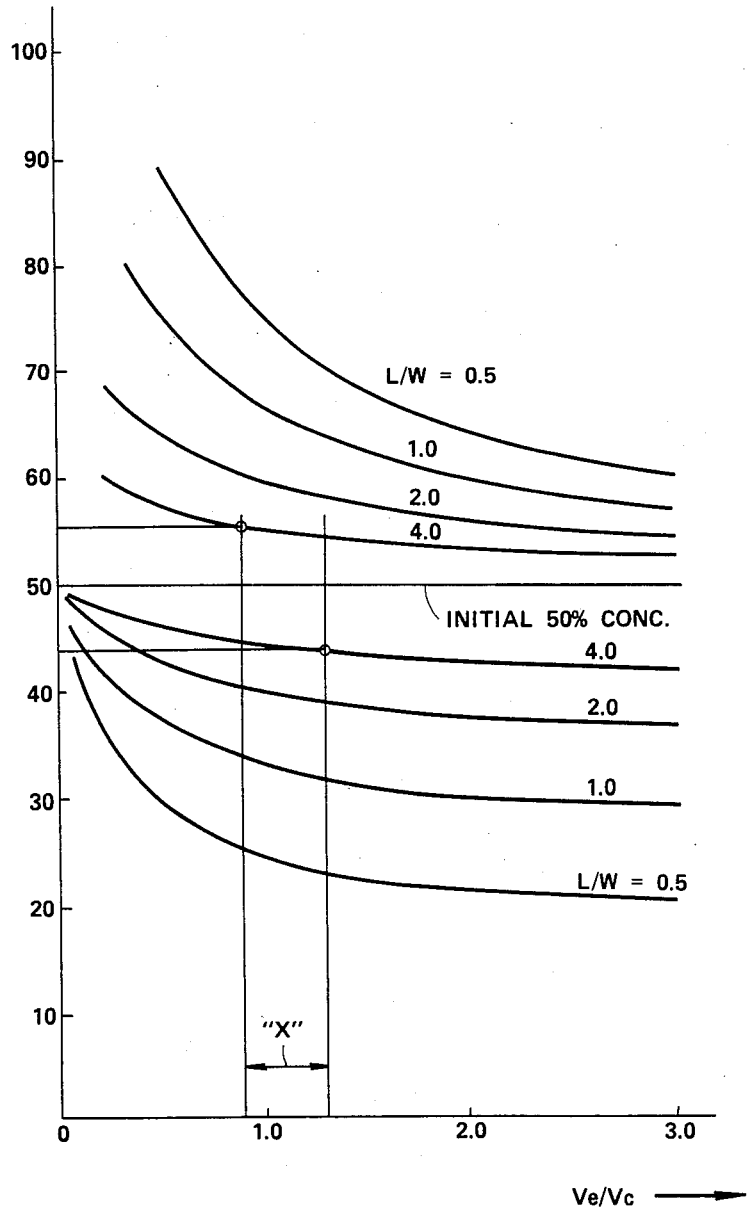

FIG. 12 shows the results of a simulation experiment which was conducted to determine the factors which effect the distribution of the anti-freeze. This experiment was conducted on the assumption that when an aqueous solution of ethylene glycol is boiled the vapor contains only water. However, in actual act when a 50% solution of ethylene glycole was boiled the vapor contained approximately 2% of the anti-freeze.

By using the following equations:

$$\frac{dCc}{dt} = \frac{1}{Vc}\{(Vc - (W + L)Cc + LCe)\} \quad (1)$$

$$\frac{dCe}{dt} = \frac{1}{Ve}\{(W + L)Cc + (Ve - L)Ce\} \quad (2)$$

wherein:

Cc denotes the concentration of the anti-freeze in the condensor;

Vc the amount of aqueous solution in the radiator;

Ve the amount of aqueous solution in the coolant jacket;

L the amount of liquid coolant that moves with the vapor; and

W the amount of vapor produced:

an effort was made to develop a model which would reveal how the initial 50% concentration becomes distributed and in what manner the concentrations in the coolant jacket and radiator could be expected to differ.

By plotting equilibrium concentration against the ratio of L/W and Ve/Vc it was revealed that the concentration unbalance in terms of equilibrium concentration becomes marked as the amount of liquid coolant which is moved with the vapor reduces and that the concentration of anti-freeze in the condensor reduces notably as the rate Ve/Vc increases while on the contrary the concentration in the coolant jacket tends to reduce as Ve/Vc increases.

However, when considering the tendancy for the coolant in the radiator to freeze, it should be noted that in cold climates where freezing is likely to occur the radiator is apt to be at least partially filled with liquid coolant in order to reduce the heat exchange efficiency of the device and thus maintain the boiling point of the coolant at the desired target level. Thus, when an internal combustion engine suited for a small automotive vehicle is used, a Ve/Vc rate of 0.9 to 1.3 (see range "X") has been found suitable to hold the distribution of the anti-freeze within 50 plus or minus 6% hence achieving a freezing point of −30° C.

As will be clear from a comparison of the results shown in FIG. 11, the simulation of FIG. 12 shows good agreement with the empirically derived ones thus confirming that a L/W rate of 4 is necessary to hold the distribution within desired limits.

Figure 13:
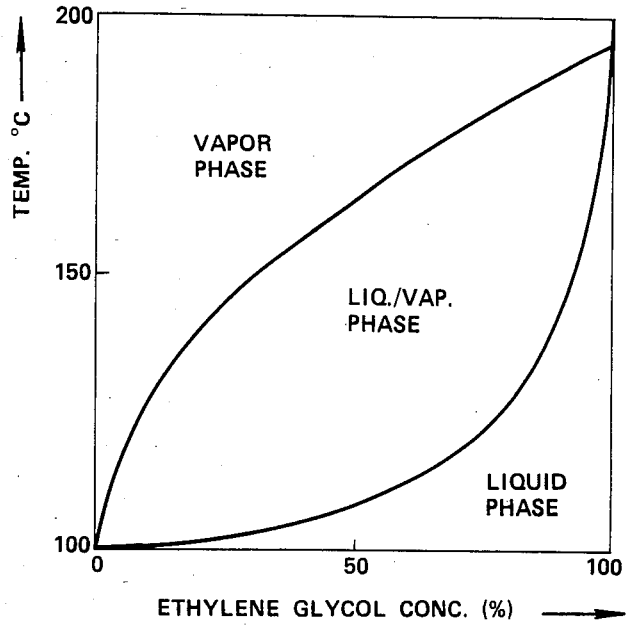
Figure 14:
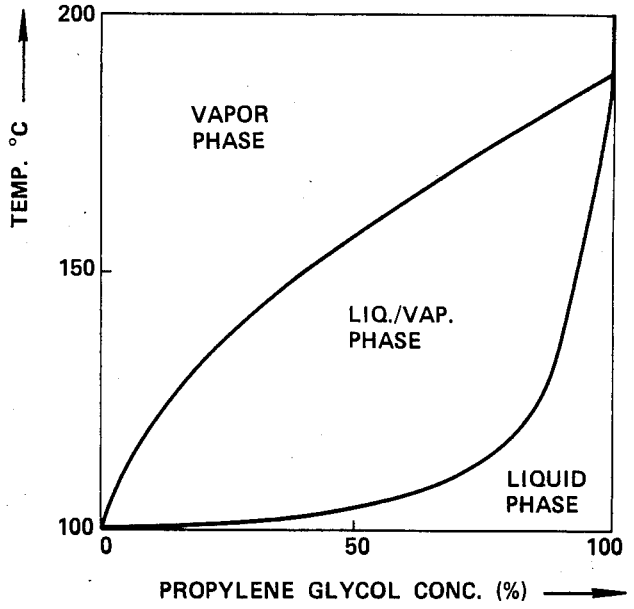

When propylene glycol is used in place of ethylene glycol essentially the same results as shown in FIGS. 11 and 12 are obtained. FIGS. 13 and 14 are respectively phase diagrams which show the characteristics of the two materials which effect the amount of anti-freeze which is contained in the coolant vapor and which induces the "distillation-like" effect which induces the dilution of the radiator anti-freeze concentration.

What is claimed is:

1. In an internal combustion engine having a structure subject to high heat flux, a cooling system for removing heat from said engine comprising:

(a) a cooling circuit which includes:

a coolant jacket formed about said structure, said coolant jacket being arranged to receive coolant in liquid form and discharge same in gaseous form;

a radiator which fluidly communicates with said coolant jacket and in which gaseous coolant produced in said coolant jacket is condensed to its liquid form; and means for returning the condensate formed in said radiator to said coolant jacket in a manner which maintains said structure subject to high heat flux immersed in a predetermined depth of liquid coolant;

(b) an auxiliary circuit which fluidly communicates with said cooling circuit, said auxiliary circuit including:

an induction conduit which fluidly commuicates with said cooling jacket;

a return conduit which fluidly communicates with said coolant jacket; and tions in said cooling circuit which causes the coolant to boil at said most suitable temperature.

10. A cooling system as claimed in claim 9, wherein said auxiliary circuit is a vehicle cabin heating circuit having a core via which air is heated for the purposes of cabin heating.

11. A method of cooling an internal combustion engine having a structure subject to high heat flux comprising the steps of:

introducing liquid coolant containing an anti-freeze into a coolant jacket disposed about the heated structure;

permitting the liquid coolant to boil and produce coolant vapor;

condensing the vapor produced in the coolant jacket in a radiator;

circulating a portion of the heated liquid coolant through an auxiliary circuit using a circulation pump;

transferring a portion of the circulation pump discharge to said radiator in a manner to blend with the condensate formed therein and maintain the concentration of anti-freeze in the coolant in the coolant jacket approximately equal to that in the coolant in the radiator.

* * * * *